US011590628B2

(12) United States Patent
Lee et al.

(10) Patent No.: US 11,590,628 B2
(45) Date of Patent: Feb. 28, 2023

(54) ROTARY BODY MODULE AND CHEMICAL MECHANICAL POLISHING APPARATUS HAVING THE SAME

(71) Applicant: Samsung Electronics Co., Ltd., Suwon-si (KR)

(72) Inventors: Yonghee Lee, Seoul (KR); Yungjun Kim, Seoul (KR); Hyunjoon Park, Suwon-si (KR); Taemin Earmme, Hwaseong-si (KR); Seungchul Han, Suwon-si (KR); Byoungho Kwon, Hwaseong-si (KR); Kuntack Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 553 days.

(21) Appl. No.: 16/747,034

(22) Filed: Jan. 20, 2020

(65) Prior Publication Data

US 2021/0008686 A1 Jan. 14, 2021

(30) Foreign Application Priority Data

Jul. 8, 2019 (KR) ..... 10-2019-0082013

(51) Int. Cl.
*B24B 37/20* (2012.01)
*B24B 37/005* (2012.01)
*B24B 37/30* (2012.01)

(52) U.S. Cl.
CPC ..... *B24B 37/20* (2013.01); *B24B 37/005* (2013.01); *B24B 37/30* (2013.01)

(58) Field of Classification Search
CPC ..... B24B 37/30; B24B 37/32; B24B 37/10; B24B 37/105; B24B 37/107;
(Continued)

(56) References Cited

U.S. PATENT DOCUMENTS 6,059,638 A 5/2000 Crevasse et al.
6,196,896 B1 3/2001 Sommer
(Continued)

FOREIGN PATENT DOCUMENTS

JP H0945642 A 2/1997
JP 2000190202 A 7/2000
(Continued)

*Primary Examiner* — Joel D Crandall
*Assistant Examiner* — Robert F Neibaur
(74) *Attorney, Agent, or Firm* — Muir Patent Law, PLLC

(57) ABSTRACT

A chemical mechanical polishing apparatus includes a fixing portion; and a rotary body module including a rotating shaft rotatably installed on the fixing portion, a first rotating unit connected to the rotating shaft and on which a wafer is mounted, and a second rotating unit disposed around the first rotating unit and on which a retainer ring is mounted, wherein the fixing portion comprises a first driving member disposed above the first rotating unit and a second driving member disposed above the second rotating unit, wherein the first and second driving members are comprised of a magnet or an electromagnet, wherein a first magnet, disposed opposite to the first driving member, is provided in the first rotating unit, and a second magnet, disposed opposite to the second driving member, is provided in the second rotating unit, and wherein the first rotating unit and the second rotating unit are independently tilted.

15 Claims, 9 Drawing Sheets

(58) Field of Classification Search
CPC ..... B24B 41/007; B24B 41/061; B24B 47/00; B24B 47/10; B24B 47/12; B24B 49/16
USPC ..... 451/285, 287, 342, 343, 360, 363, 397, 451/398
See application file for complete search history.

(56) References Cited

U.S. PATENT DOCUMENTS

| | | | | |
|---|---|---|---|---|
| 6,354,907 | B1 | 3/2002 | Satoh et al. | |
| 6,354,928 | B1 | 3/2002 | Crevasse et al. | |
| 6,592,434 | B1 | 7/2003 | Vanell et al. | |
| 6,857,950 | B2 * | 2/2005 | Hayashi | B24B 41/068 438/692 |
| 8,357,029 | B2 | 1/2013 | Fukushima et al. | |
| 8,382,558 | B2 * | 2/2013 | Watanabe | B24B 53/017 451/288 |
| 8,485,866 | B2 | 7/2013 | Yasuda et al. | |
| 9,403,255 | B2 | 8/2016 | Fukushima et al. | |
| 9,662,764 | B2 * | 5/2017 | Fukushima | B24B 37/042 |
| 9,849,557 | B2 * | 12/2017 | Shinozaki | B24B 37/105 |
| 10,702,972 | B2 * | 7/2020 | Fukushima | B24B 37/32 |
| 2012/0118504 | A1 * | 5/2012 | Nomura | H01L 21/68792 451/75 |
| 2015/0328743 | A1 | 11/2015 | Nabeya | |
| 2018/0065228 | A1 | 3/2018 | Nabeya | |

FOREIGN PATENT DOCUMENTS

| | | | |
|---|---|---|---|
| JP | 2004265950 | A | 9/2004 |
| KR | 1020000061764 | A | 10/2000 |

* cited by examiner

ROTARY BODY MODULE AND CHEMICAL MECHANICAL POLISHING APPARATUS HAVING THE SAME

This application claims benefit of priority to Korean Patent Application No. 10-2019-0082013, filed on Jul. 8, 2019, in the Korean Intellectual Property Office, the disclosure of which is incorporated by reference herein in its entirety.

BACKGROUND

The present inventive concept relates to a rotary body module, and a chemical mechanical polishing apparatus having the same.

A chemical mechanical polishing (CMP) process using a chemical mechanical polishing (CMP) apparatus may be used for planarization of a wafer in manufacturing semiconductor devices. There may be situations in which, when the chemical mechanical polishing process is performed, reliability for planarization of a wafer may be lowered, because the wafer may not be kept horizontal due to high integration of semiconductor devices and large aperture of a wafer.

SUMMARY

An aspect of the present inventive concept is to provide a chemical mechanical polishing apparatus capable of independently maintaining horizontal positions of a wafer and a retainer ring.

According to an aspect of the present inventive concept, the disclosure is directed to a chemical mechanical polishing apparatus comprising: a fixing portion; and a rotary body module including a rotating shaft rotatably provided on the fixing portion, a first rotating unit connected to the rotating shaft and on which a wafer is mounted, and a second rotating unit disposed around the first rotating unit and on which a retainer ring is mounted, wherein the fixing portion comprises a first driving member disposed above the first rotating unit and a second driving member disposed above the second rotating unit, wherein the first and second driving members are comprised of a magnet or an electromagnet, wherein a first magnet, disposed opposite to the first driving member, is provided in the first rotating unit, and a second magnet, disposed opposite to the second driving member, is provided in the second rotating unit, and wherein the first rotating unit and the second rotating unit are independently tilted.

According to an aspect of the present inventive concept, the disclosure is directed to a chemical mechanical polishing apparatus comprising: a fixing portion; and a rotary body module including a rotating shaft rotatably provided on the fixing portion, a first rotating unit connected to the rotating shaft and on which a wafer is mounted, and a second rotating unit disposed around the first rotating unit and on which a retainer ring is mounted, wherein the fixing portion comprises a first driving member disposed above the first rotating unit and a second driving member disposed above the second rotating unit, wherein each of the first and second driving members are comprised of a cylinder, and wherein the first rotating unit and the second rotating unit are configured to be independently tilted.

According to an aspect of the present inventive concept, the disclosure is directed to a rotary body module comprising: a rotating shaft attached to a fixing portion; a first rotating unit connected to the rotating shaft and on which a wafer is mounted; and a second rotating unit disposed around the first rotating unit and on which a retainer ring is mounted, wherein the first rotating unit and the second rotating unit are configured to be independently tilted.

BRIEF DESCRIPTION OF DRAWINGS

The above and other aspects, features, and advantages of the present inventive concept will be more clearly understood from the following detailed description, taken in conjunction with the accompanying drawings, in which.

DETAILED DESCRIPTION

Figure 1:
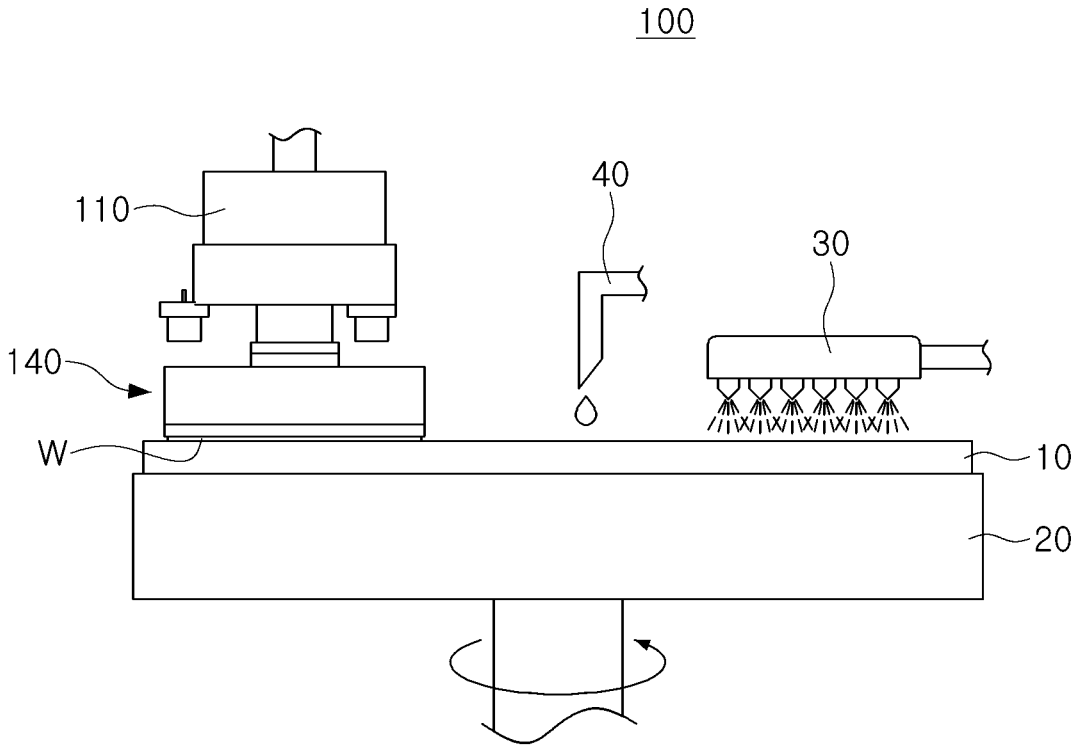
FIG. 1 is a configuration diagram illustrating a chemical mechanical polishing apparatus according to an example embodiment.

Hereinafter, example embodiments of the present inventive concept will be described with reference to the accompanying drawings. In the drawings, like numbers refer to like elements throughout.

FIG. 1 is a configuration diagram illustrating a chemical mechanical polishing apparatus according to an example embodiment.

Referring to FIG. 1, a chemical mechanical polishing apparatus 100 may include a fixing portion 110, a rotary body module 140 for pressing a wafer W, a structure (not illustrated) for rotating the rotary body module 140, a polishing pad 10 contacting a lower surface of the wafer W, a rotating plate 20 to which the polishing pad 10 is attached and by which the polishing pad 10 is rotated, and a conditioner (not illustrated) for recovering surface state of the polishing pad 10. The chemical mechanical polishing apparatus 100 may further include a polishing pad cleaning unit 30 for cleaning the polishing pad 10, and a slurry supplying unit 40 for supplying a slurry to the polishing pad 10.

As described above, the wafer W provided on a lower surface of the rotary body module 140 may come into contact with the polishing pad 10, to perform a chemical mechanical polishing process.

Figure 2:
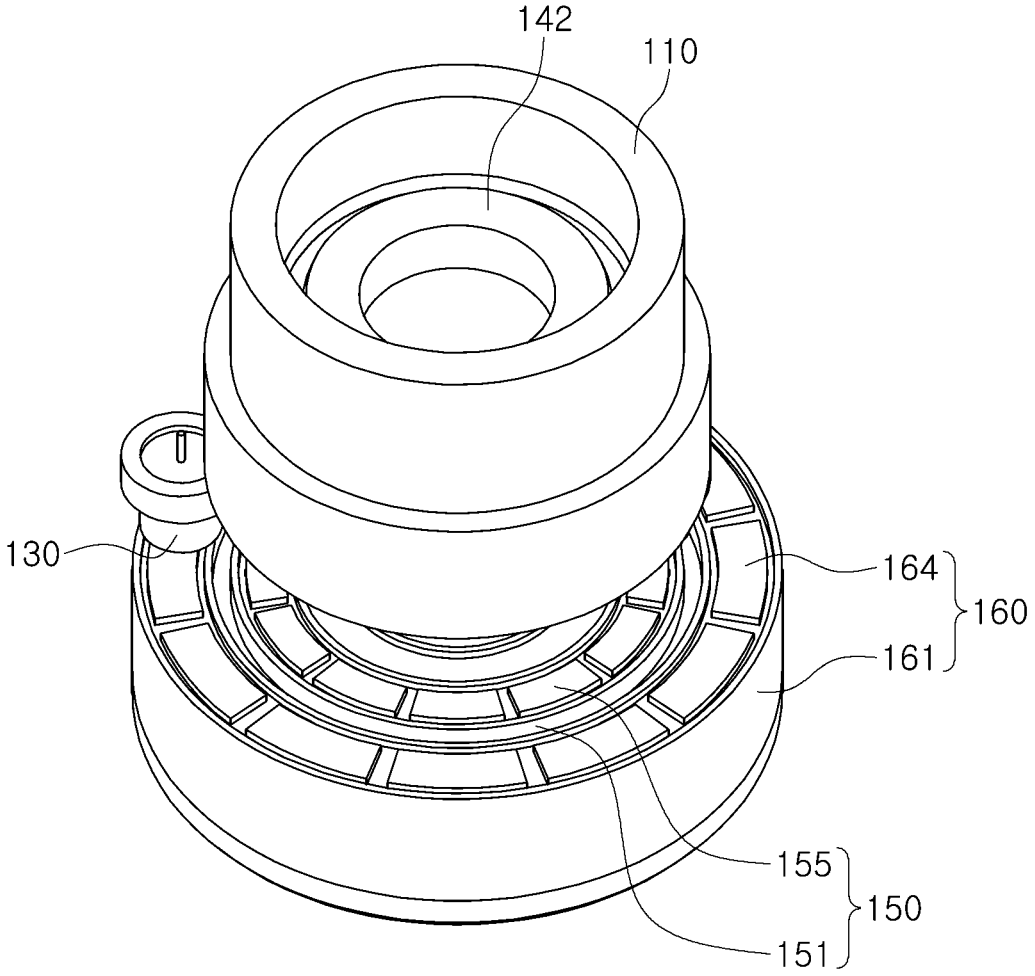
FIG. 2 is a perspective view illustrating a rotary body module of a chemical mechanical polishing apparatus according to an example embodiment.
Figure 3:
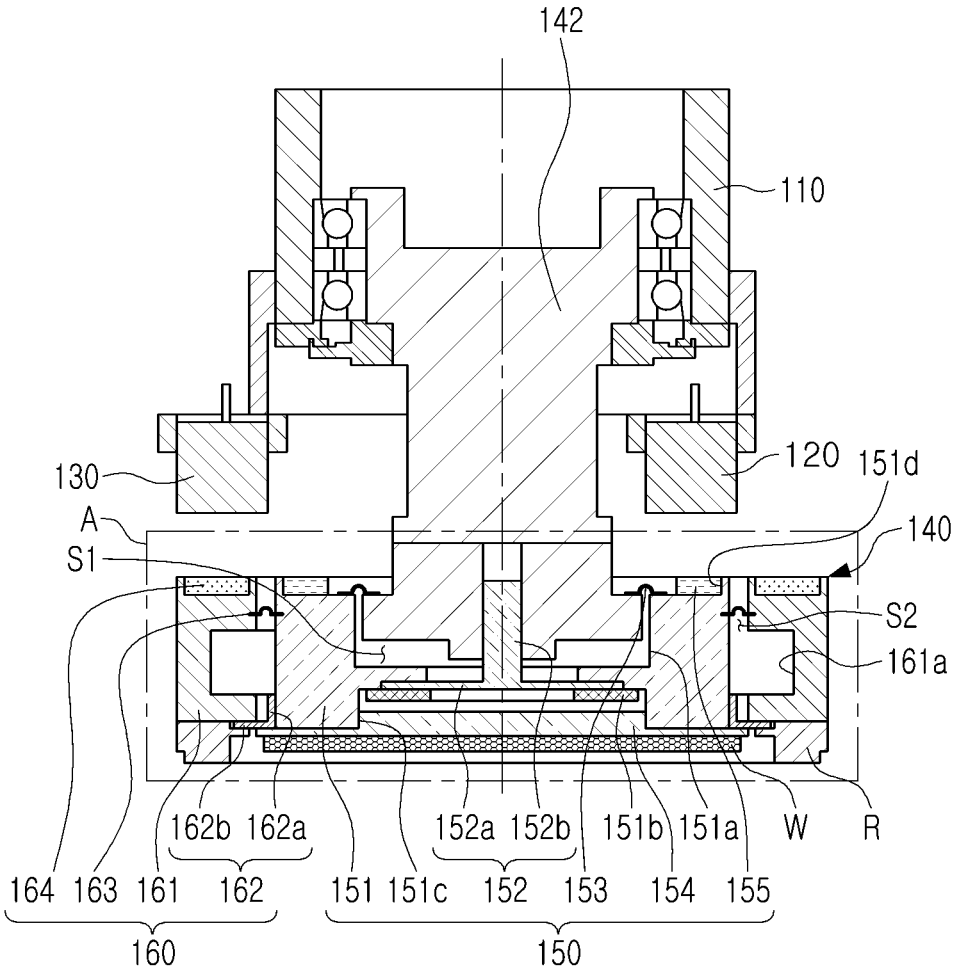
FIG. 3 is a cross-sectional view illustrating a fixing portion and a rotary body module of a chemical mechanical polishing apparatus according to an example embodiment.
Figure 4:
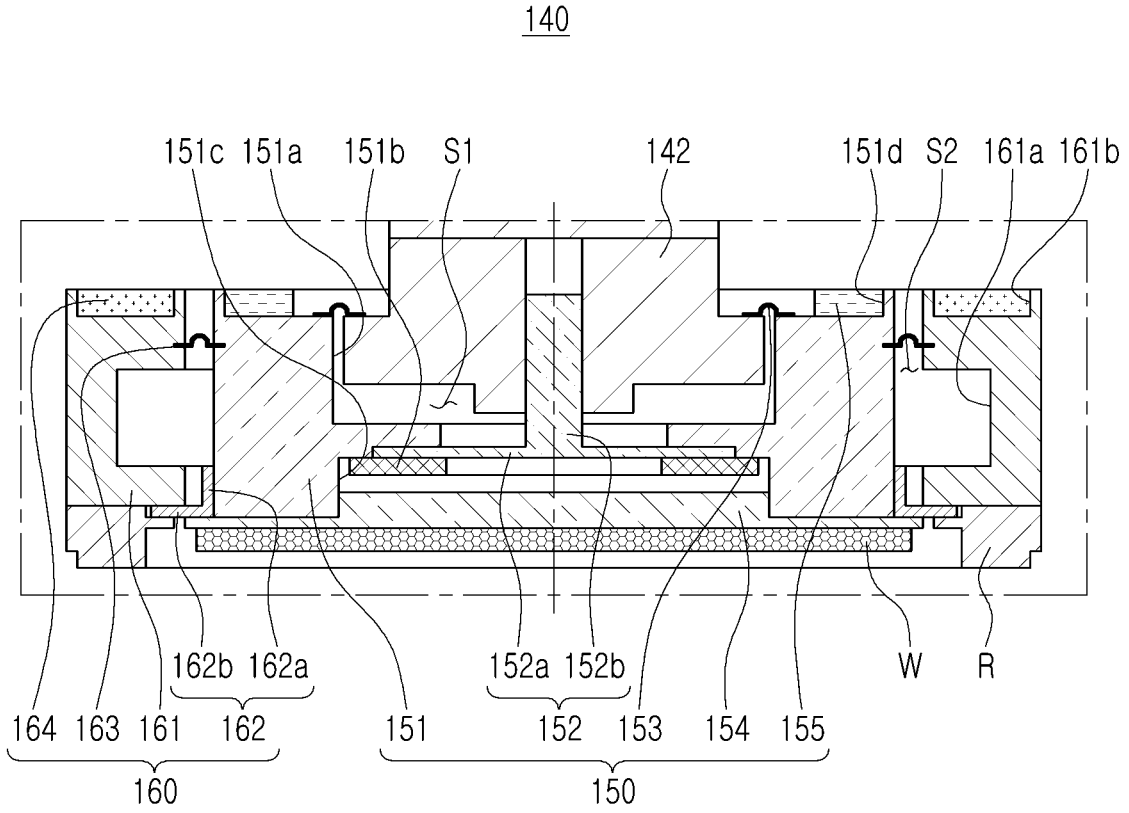
FIG. 4 is an enlarged view illustrating portion A of FIG. 3.
Figure 5:
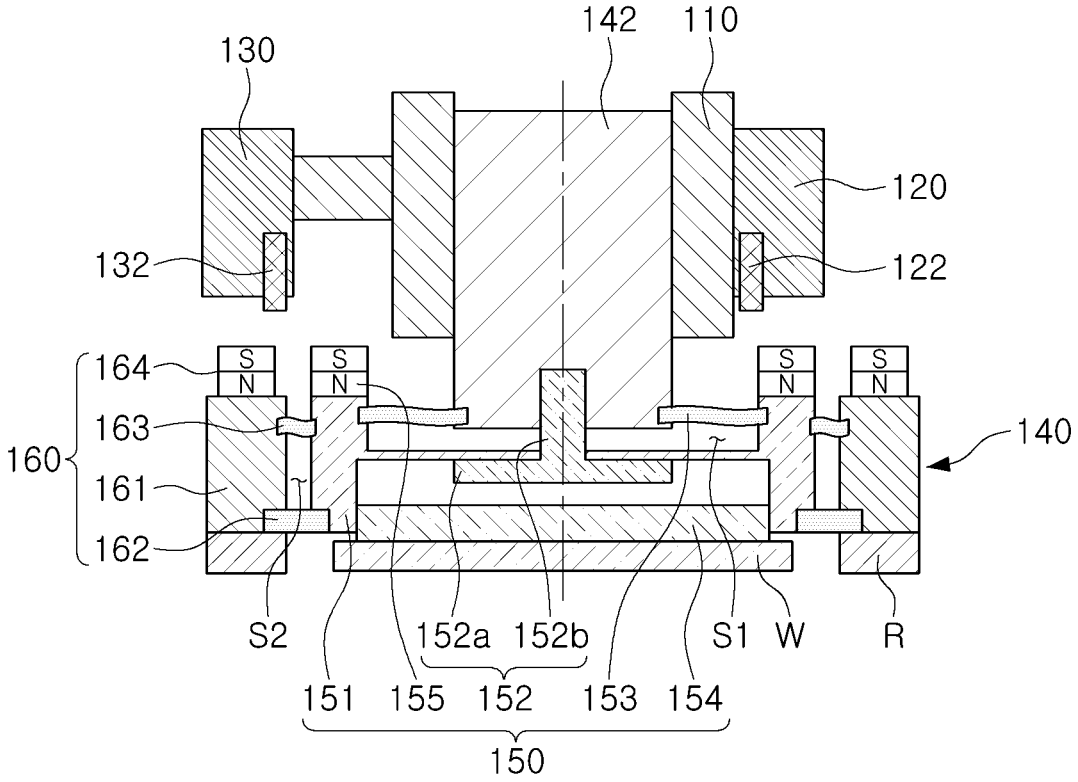
FIG. 5 is a schematic configuration diagram illustrating a fixing portion and a rotary body module of a chemical mechanical polishing apparatus according to an example embodiment.

FIG. 2 is a perspective view illustrating a rotary body module of a chemical mechanical polishing apparatus according to an example embodiment, FIG. 3 is a cross-sectional view illustrating a fixing portion and a rotary body module of a chemical mechanical polishing apparatus according to an example embodiment, FIG. 4 is an enlarged view illustrating portion A of FIG. 3, and FIG. 5 is a schematic configuration diagram illustrating a fixing portion and a rotary body module of a chemical mechanical polishing apparatus according to an example embodiment.

Referring to FIGS. 2 to 5, a chemical mechanical polishing apparatus 100 may include a fixing portion 110 and a rotary body module 140.

The fixing portion 110 may rotatably support the rotary body module 140, and a driving motor (not illustrated) for rotating the rotary body module 140 may be provided on the fixing portion 110. For example, the rotary body module 140 may be provided on or attached to the fixing portion 110 such that the rotary body module 140 is able to rotate. The fixing portion 110 may include a first driving member 120 and a second driving member 130 for providing driving force for tilting the rotary body module 140. Details of the first driving member 120 and the second driving member 130 will be described later.

The rotary body module 140 may include a rotating shaft 142, a first rotating unit 150, and a second rotating unit 160.

The rotating shaft 142 may be rotatably installed on the fixing portion 110. For example, the rotating shaft 142 may be provided on or attached to the fixing portion 110 such that the rotating shaft 142 is able to rotate. Then, the rotating shaft 142 may be connected to the driving motor and rotated. The first rotating unit 150 may be connected to the rotating shaft 142. Therefore, the first rotating unit 150 may be rotated in conjunction with the rotating shaft 142.

The first rotating unit 150 may be connected to the rotating shaft 142, and the wafer W may be mounted on a lower surface of the first rotating unit 150. For example, the first rotating unit 150 may include a first body 151, a first flexible member 152, a first sealing member 153, a membrane 154, and a first magnet 155. In some embodiments, the wafer W may be mounted on a lower surface of the membrane 154.

The first body 151 may be provided on the rotating shaft 142 through the first flexible member 152. A first insertion groove 151*a* into which an end portion of the rotating shaft 142 is inserted may be provided in the first body 151. When the first body 151 is installed on the rotating shaft 142, a space S1 may be formed by the first body 151 and the rotating shaft 142. For example, the space S1 may be formed between the first body 151 and the rotating shaft 142. Clean dry air (CDA) or the like may be supplied into the space S1. Therefore, a wafer W provided on a lower surface of the membrane 154 may be pneumatically pressed. The first body 151 may have a fixture 151*b* (see FIG. 4) for fixing the first flexible member 152.

A second insertion groove 151*c* into which a portion of the membrane 154 is inserted may be provided below the first insertion groove 151*a* of the first body 151.

A first installation groove 151*d* for which the first magnet 155 is inserted and installed may be provided on an upper end portion of the first body 151.

The first flexible member 152 may connect the first body 151 to the rotating shaft 142. For example, the first flexible member 152 may include a plate portion 152*a* fixed to the first body 151, and an extension portion 152*b* extended from the plate portion 152*a* to the rotating shaft 142. The extension portion 152*b* may extend into a central area of the rotating shaft 142. When the first body 151 is tilted by a driving force applied by the first driving member 120 and the first magnet 155, the first flexible member 152 may be elastically deformed. For example, the first flexible member 152 may be made of a material that may be not deformed when a driving force is not applied by the first driving member 120 and the first magnet 155, and that may be elastically deformed only when a driving force is applied by the first driving member 120 and the first magnet 155. When the first driving member 120 and the first magnet 155 do not provide a driving force (e.g., when the driving force is removed), the first flexible member 152 may be restored to its original shape by restoring force. For example, the first flexible member 152 may be made of any one of an engineering plastic material and a stainless steel (SUS) material.

The first sealing member 153 may seal a space formed by the first body 151 and the rotating shaft 142. Since the space S1 may be sealed by the first sealing member 153 as described above, when a fluid such as clean dry air (CDA) or the like is supplied to the space S1, the wafer W (see FIG. 5) may be pneumatically brought into close contact with the polishing pad 10 (see FIG. 1).

The first sealing member 153 may be made of an elastic material. For example, the first sealing member 153 may be made of any one of silicone and rubber. Therefore, even when the first body 151 is tilted, the space S1 may remain sealed.

The membrane 154 may be fixed to and installed on a lower end portion of the first body 151, and the wafer W may be provided on a lower surface of the first body 151. For example, the membrane 154 may include a flexible material, and may be inflated like a balloon when a fluid such as clean dry air (CDA) or the like is inserted thereinto. Further, the fluid may be supplied from an external supply device, and supply conditions may be controlled through a controller (not illustrated).

The first magnet 155 may be inserted into the first installation groove 151*d* of the first body 151. For example, the first magnet 155 may be installed such that an N pole (e.g., negative or cathode) is disposed in a lower portion of the first installation groove 151*d* and an S pole (e.g., positive or anode) is disposed in an upper portion thereof. The present inventive concept is not limited thereto, and the first magnet 155 may be installed such that the S pole is disposed in the lower portion of the first installation groove 151*d* and the N pole is disposed in the upper portion thereof. In either case, the first magnet 155 may be provided such that the N pole and the S pole are positioned to be aligned with the longitudinal direction of the rotating shaft 142. For example, an anode and cathode of the first magnet 155 may be sequentially stacked in the longitudinal direction of the rotating shaft 142.

The first driving member 120 may be disposed above the first magnet 155. For example, in a case in which the first driving member 120 is made of an electromagnet, attractive force or repulsive force may be applied to the first driving member 120 and the first magnet 155, when a current is applied to the first driving member 120.

Therefore, the first body 151 may be tilted by the first driving member 120 and the first magnet 155. In this case, since the first body 151 is connected to the rotating shaft 142 by the first flexible member 152, the first body 151 may be easily tilted. Thereafter, when no current is applied to the first driving member 120, the first flexible member 152 may be restored and the first body 151 may be returned to its original shape.

As described above, a direction and magnitude of magnetic force may be controlled by adjusting a direction of the current applied to the first driving member 120 or by controlling a magnitude of the current.

The first driving member 120 may be provided with a first displacement sensor 122. The first displacement sensor 122 may sense a tilting angle of the first body 151.

As an example, the first displacement sensor 122 may be connected to a controller (not illustrated), and may provide information to the controller about the sensed tilting angle of the first body 151. In this manner, the controller may control a tilting angle of the first body 151 precisely by sensing the tilting angle by the first displacement sensor 122.

A center for tilting of the first rotating unit 150 may be disposed inside the first flexible member 152.

The second rotating unit 160 may be disposed around the first rotating unit 150, and a retainer ring R may be mounted on the second rotating unit 160. For example, the second rotating unit 160 may include a second body 161, a second flexible member 162, a second sealing member 163, and a second magnet 164.

The retainer ring R may be mounted on a lower surface of the second body 161. A receiving groove 161*a* for receiving a fluid such as clean dry air (CDA) may be formed on an inner surface of the second body 161. Further, the second body 161 may have a substantially cylindrical shape.

A second installation groove 161*b* for inserting the second magnet 164 may be provided in an upper end portion of the second body 161.

The second flexible member 162 may connect the first body 151 and the second body 161. For example, as illustrated in FIG. 4 in more details, the second flexible member 162 may include a vertical portion 162*a* of which an inner surface may be bonded to an outer surface of the first body 151, and a horizontal portion 162*b* formed to extend from the vertical portion 162*a*. The horizontal portion 162*b* may be bonded to the lower surface of the second body 161.

When the second body 161 is tilted by a driving force applied by the second driving member 130 and the second magnet 164, the second flexible member 162 may be elastically deformed. For example, the second flexible member 162 may be made of a material that may be not deformed when a driving force is not applied by the second driving member 130 and the second magnet 164, and that may be elastically deformed only when a driving force is applied by the second driving member 130 and the second magnet 164. When the second driving member 130 and the second magnet 164 do not provide a driving force (e.g., when the driving force is removed), the second flexible member 162 may be restored to its original shape by restoring force. For example, the second flexible member 162 may be made of any one of an engineering plastic material and a stainless steel (SUS) material.

The second sealing member 163 may seal a space S2 formed by the first body 151 and the second body 161, together with the second flexible member 162. Since the space S2 may be sealed by the second sealing member 163 as described above, when a fluid such as clean dry air (CDA) or the like is supplied to the space S2, formed by the first body 151 and the second body 161, the retainer ring R (see FIG. 5) may be pneumatically brought into close contact with the polishing pad 10 (see FIG. 1).

The second sealing member 163 may be made of an elastic material. For example, the second sealing member 163 may be made of any one of silicone and rubber. Therefore, even when the second body 161 is tilted, the space S2 may remain sealed.

The second magnet 164 may be inserted into and installed on the second installation groove 161*b* of the second body 161. For example, the second magnet 164 may be installed such that an N pole (e.g., negative or cathode) is disposed in a lower portion of the second installation groove 161*b* and an S pole (e.g., positive or anode) is disposed in an upper portion thereof. The present inventive concept is not limited thereto, and the second magnet 164 may be installed such that the S pole is disposed in the lower portion of the second installation groove 161*b* and the N pole is disposed in the upper portion thereof. In either case, the second magnet 164 may be provided such that the N pole and the S pole are positioned to be aligned with the longitudinal direction of the rotating shaft 142. For example, an anode and cathode of the second magnet 164 may be sequentially stacked in the longitudinal direction of the rotating shaft 142.

The second driving member 130 may be disposed above the second magnet 164. For example, in a case in which the second driving member 130 is made of an electromagnet, attractive force or repulsive force may be applied to the second driving member 130 and the second magnet 164, when a current is applied to the second driving member 130. Therefore, the second body 161 may be tilted by the second driving member 130 and the second magnet 164. In this case, since the second body 161 is connected to the first body 151 by the second flexible member 162, the second body 161 may be easily tilted. Thereafter, when no current is applied to the second driving member 130, the second flexible member 162 may be restored and the second body 161 may be returned to its original shape.

As described above, a direction and magnitude of magnetic force may be controlled by adjusting a direction of the current applied to the second driving member 130 or controlling a magnitude of the current.

In addition, the second driving member 130 may be provided with a second displacement sensor 132. The second displacement sensor 132 may sense a tilting angle of the second body 161. As an example, the second displacement sensor 132 may be connected to a controller (not illustrated), and may provide information to the controller about the sensed tilting angle of the second body 161. In this manner, the controller may control a tilting angle of the second body 161 precisely by sensing the tilting angle by the second displacement sensor 132.

Since the first rotating unit 150 and the second rotating unit 160 may be separately tilted as described above, the wafer W and the retainer ring R may be brought into close contact with the polishing pad 10 (see FIG. 1). Further, horizontal positions of the wafer W and the retainer ring R may be maintained separately.

Hereinafter, an operation of a rotary body module will be described with reference to the drawings.

Figure 6:
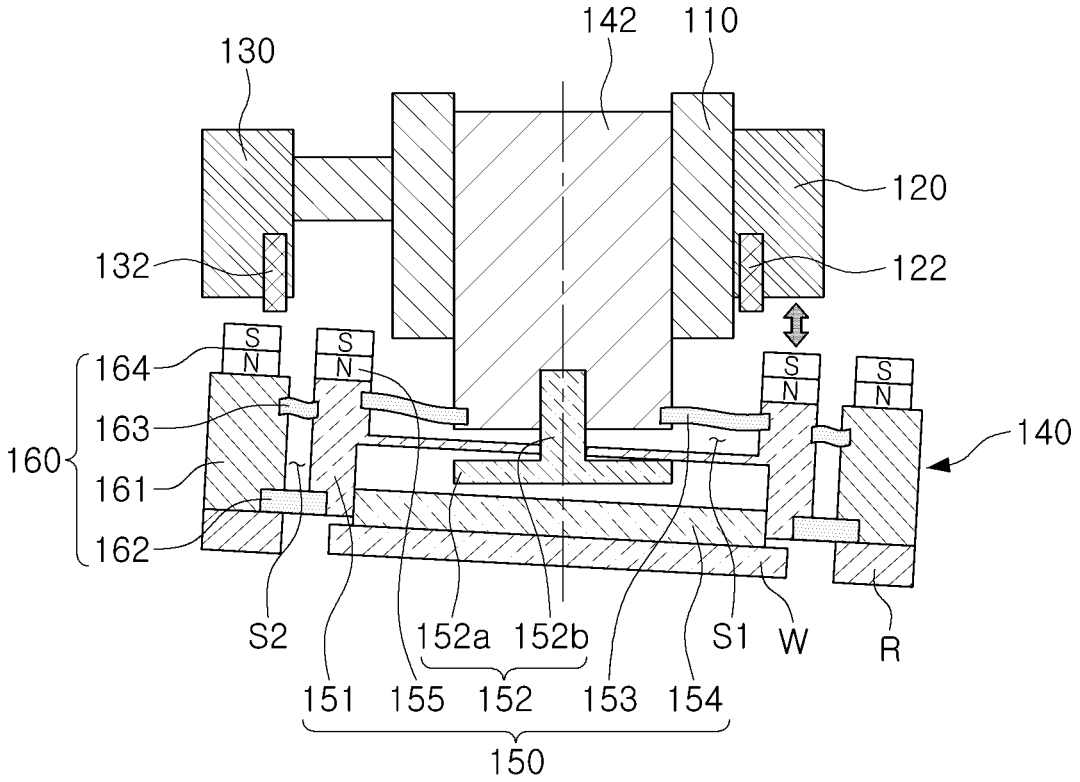
FIGS. 6 and 7 are explanatory diagrams illustrating an operation of a rotary body module of a chemical mechanical polishing apparatus according to an example embodiment.
Figure 7:
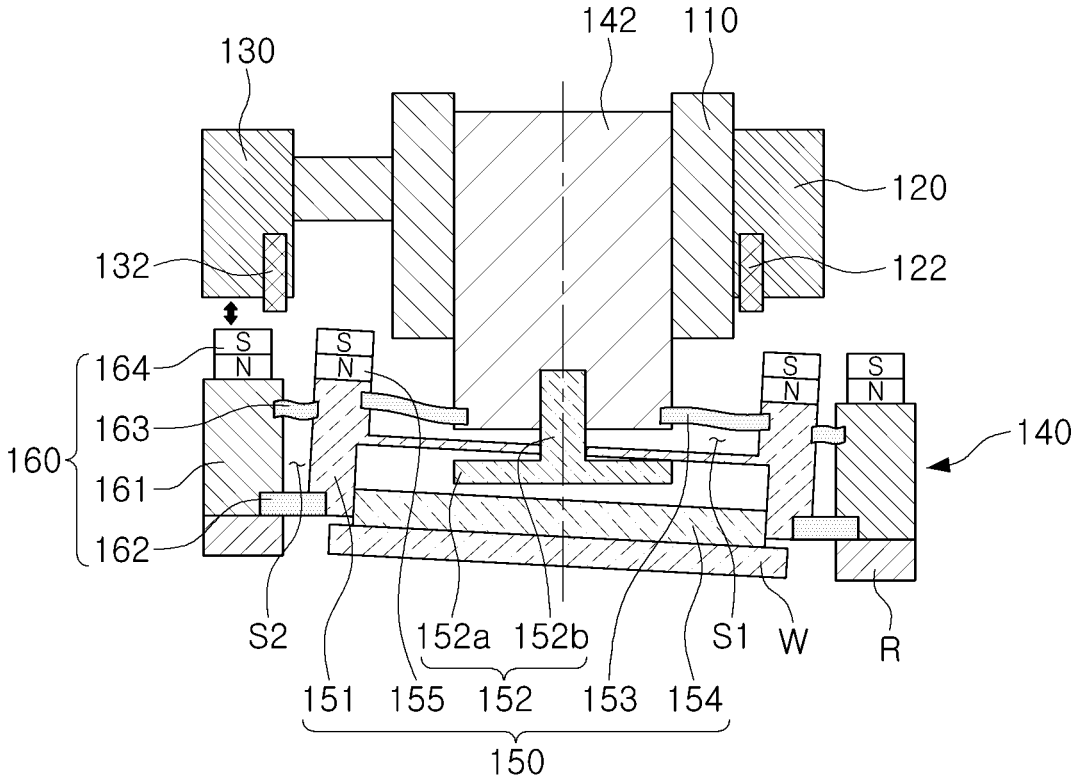

FIGS. 6 and 7 are explanatory diagrams illustrating an operation of a rotary body module of a chemical mechanical polishing apparatus according to an example embodiment.

As illustrated in FIG. 6, when a current is applied to the first driving member 120 to apply repulsive force to the first driving member 120 and the first magnet 155, the entirety of the rotary body module 140 may be inclined in one direction.

In this state, as illustrated in FIG. 7, when a current is applied to the second driving member 130 to apply repulsive force to the second driving member 130 and the second magnet 164, only the second rotating unit 160 may be inclined. In this manner, tilting angles of the first rotating unit 150 and the second rotating unit 160 may be formed to be different from each other.

The wafer W provided on the first rotating unit 150 and the retainer ring R provided on the second rotating unit 160 may be independently tilted.

Figure 8:
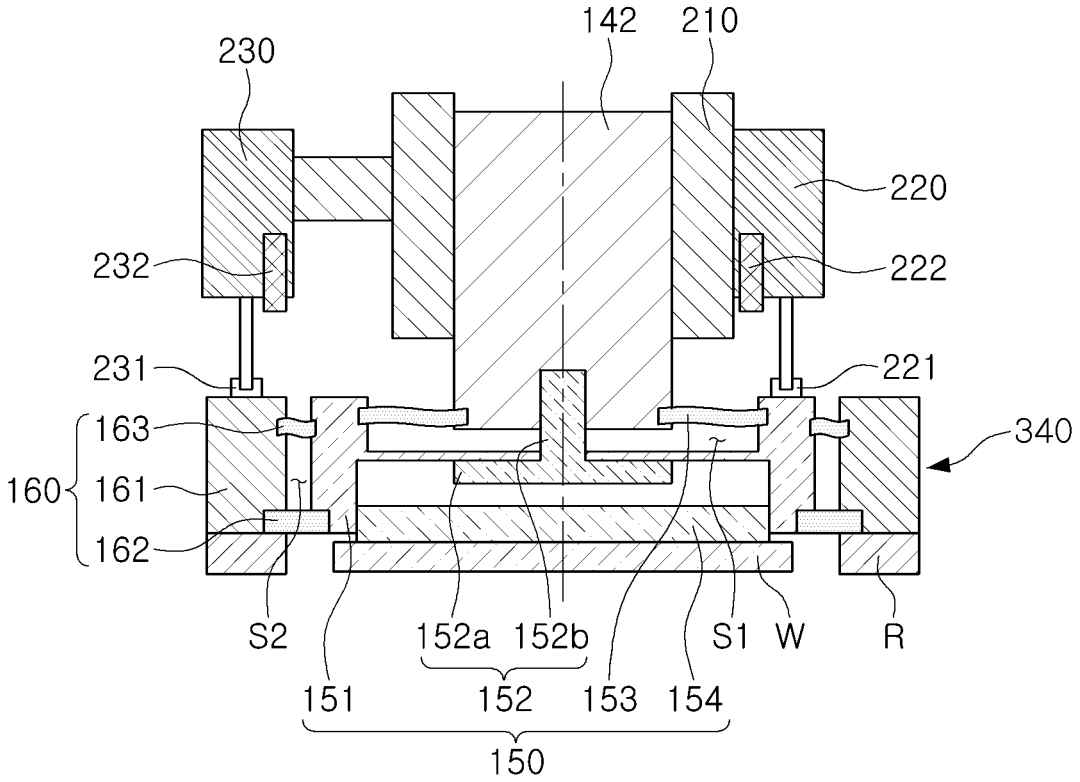
FIG. 8 is a schematic configuration diagram illustrating a modified embodiment of a fixing portion and a rotary body module provided in a chemical mechanical polishing apparatus according to an example embodiment.

FIG. 8 is a schematic configuration diagram illustrating a modified embodiment of a fixing portion and a rotary body module provided in a chemical mechanical polishing apparatus according to an example embodiment.

Referring to FIG. 8, a fixing portion 210 may rotatably support a rotary body module 240, and a driving motor (not illustrated) for rotating the rotary body module 240 may be provided in the fixing portion 210. For example, the rotary body module 240 may be provided on or attached to the fixing portion 110 such that the rotary body module 240 is able to rotate. The fixing portion 210 may include a first driving member 220 and a second driving member 230 for providing driving force for tilting the rotary body module 240.

The first driving member 220 and the second driving member 230 each may be comprised of a cylinder. For example, each of the first driving member 220 and the second driving member 230 may have a cylinder shape. A first roller 221 contacting a first rotating unit 250 to be described later may be provided on an end of the first driving member 220. Therefore, even when the first driving member 220 is pressed against the first rotating unit 250 to be rotated, rotation of the first rotating unit 250 may be prevented.

A second roller 231 contacting a second rotating unit 260 to be described later may be provided on an end of the second driving member 230.

The first driving member 220 may be provided with a first displacement sensor 222. The first displacement sensor 222 may sense a tilting angle of the first rotating unit 250. As an example, the first displacement sensor 222 may be connected to a controller (not illustrated), and may provide information to the controller about the sensed tilting angle of the first rotating unit 250. In this manner, the controller may control a tilting angle of the first rotating unit 250 precisely by sensing the tilting angle by the first displacement sensor 222.

In addition, the second driving member 230 may be provided with a second displacement sensor 232. The second displacement sensor 232 may sense a tilting angle of the second rotating unit 260. As an example, the second displacement sensor 232 may be connected to a controller (not illustrated), and may provide information to the controller about the sensed tilting angle of the second rotating unit 260. In this manner, the controller may control a tilting angle of the second rotating unit 260 precisely by sensing the tilting angle by the second displacement sensor 232.

Since the rotary body module 240 is substantially the same as the rotary body module 140, except that the first and second magnets 155 and 164 included in the rotary body module 140 are excluded, the detailed description of the first and second rotating units 150 and 160 of the rotary body module 240 will be omitted.

Figure 9:
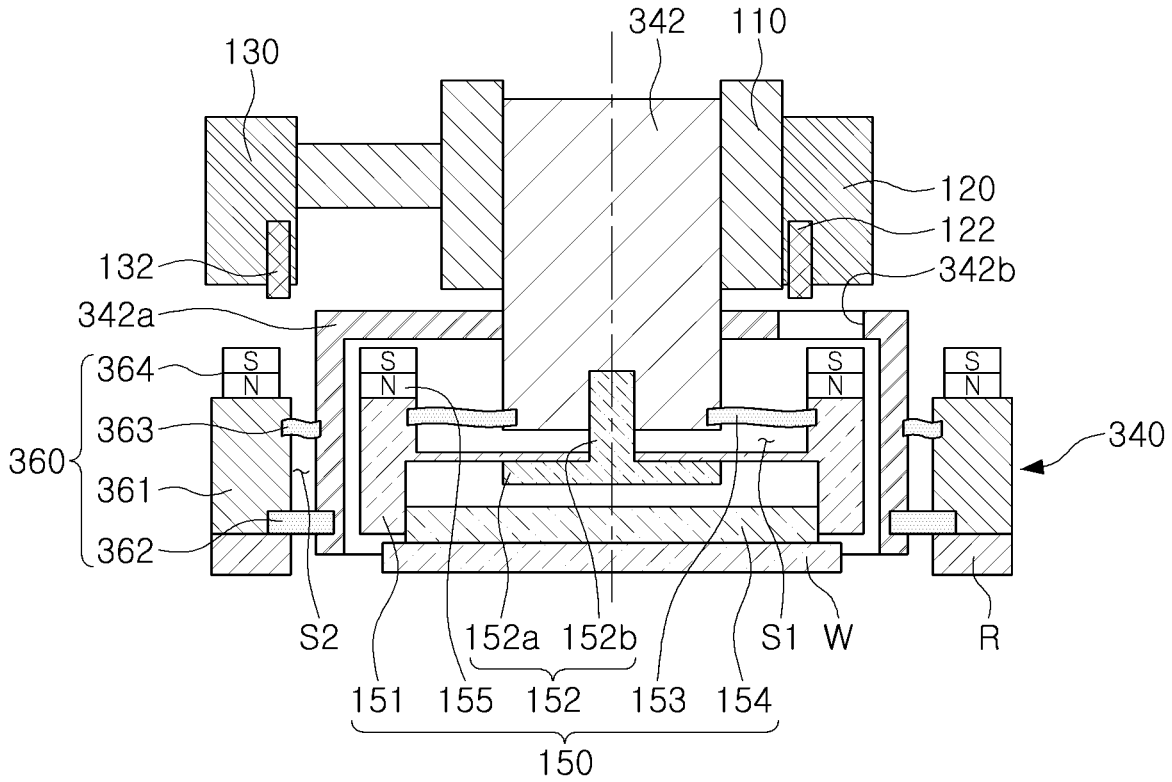
FIG. 9 is a schematic configuration diagram illustrating another modified embodiment of a fixing portion and a rotary body module provided in a chemical mechanical polishing apparatus according to an example embodiment.

FIG. 9 is a schematic configuration diagram illustrating another modified embodiment of a fixing portion and a rotary body module provided in a chemical mechanical polishing apparatus according to an example embodiment.

Referring to FIG. 9, a fixing portion 110 may rotatably support a rotary body module 340, and a driving motor (not illustrated) for rotating the rotary body module 340 may be provided in the fixing portion 110. For example, the rotary body module 340 may be provided on or attached to the fixing portion 110 such that the rotary body module 340 is able to rotate. The fixing portion 110 may include a first driving member 120 and a second driving member 130 for providing driving force for tilting the rotary body module 340. Details of the first driving member 120 and the second driving member 130 will be described later.

The rotary body module 340 may include a rotating shaft 342, a first rotating unit 150, and a second rotating unit 360.

The rotating shaft 342 may be rotatably installed on the fixing portion 110. For example, the rotating shaft 342 may be provided on or attached to the fixing portion 110 such that the rotating shaft 342 is able to rotate. Then, the rotating shaft 342 may be connected to the driving motor and rotated. The first rotating unit 150 may be connected to the rotating shaft 342. Therefore, the first rotating unit 150 may be rotated in conjunction with the rotating shaft 342.

The rotating shaft 342 may be provided with an installation member 342*a* on which the second rotating unit 360 is provided. For example, the installation member 342*a* may be disposed to surround the first rotating unit 150. The installation member 342*a* may be provided with a through-hole 342*b* disposed below the first driving member 120.

The first rotating unit 150 may be connected to the rotating shaft 342, and a wafer W may be mounted on a lower surface of the first rotating unit 150. In some embodiments, the wafer W may be mounted on a lower surface of the membrane 154. Since the first rotating unit 150 corresponds to the same components as those described above, the same reference numerals may be used to denote the same components, and a detailed description thereof will be omitted.

The first driving member 120 may be provided with a first displacement sensor 122. The first displacement sensor 122 may sense a tilting angle of the first body 151. As an example, the first displacement sensor 122 may be connected to a controller (not illustrated), and may provide information to the controller about the sensed tilting angle of the first body 151. In this manner, the controller may control a tilting angle of a first body 151 precisely by sensing the tilting angle by the first displacement sensor 122.

The second rotating unit 360 may be disposed around the first rotating unit 150, and a retainer ring R may be mounted on the second rotating unit 360. As an example, the second rotating unit 360 may include a second body 361, a second flexible member 362, a second sealing member 363, and a second magnet 364.

The retainer ring R may be mounted on a lower surface of the second body 361. A receiving groove 361*a* for receiving a fluid such as clean dry air (CDA) may be formed on an inner surface of the second body 361. Further, the second body 361 may have a substantially cylindrical shape.

A second installation groove (not illustrated) for inserting the second magnet 364 may be provided in an upper end portion of the second body 361. In some embodiments, the second installation groove may correspond to the second installation groove 161*b* of FIG. 4.

The second flexible member 362 may connect the installation member 342*a* and the second body 361. When the second body 361 is tilted by a driving force applied by the second driving member 130 and the second magnet 364, the second flexible member 362 may be elastically deformed. For example, the second flexible member 362 may be made of a material that may be not deformed when a driving force is not applied by the second driving member 130 and the second magnet 364, and that may be elastically deformed only when a driving force is applied by the second driving member 130 and the second magnet 364. When the second driving member 130 and the second magnet 364 do not provide a driving force (e.g., when the driving force is removed), the second flexible member 362 may be restored to its original shape by restoring force. For example, the second flexible member 362 may be made of any one of an engineering plastic material and a stainless steel (SUS) material.

The second sealing member 363 may seal a space S2 formed by the installation member 342*a* and the second body 361, together with the second flexible member 362. Since the space S2 may be sealed by the second sealing member 363 as described above, when a fluid such as clean dry air (CDA) or the like is supplied to the space S2, formed by the installation member 342*a* and the second body 361, a retainer ring R may be pneumatically brought into close contact with the polishing pad 10 (see FIG. 1).

The second sealing member 363 may be made of an elastic material. For example, the second sealing member 363 may be made of any one of silicone and rubber. Therefore, even when the second body 361 is tilted, the space S2 may remain sealed.

The second magnet 364 may be inserted into and installed on the second installation groove of the second body 361. For example, the second magnet 364 may be installed such that an N pole (e.g., negative or cathode) is disposed in a lower portion of the second installation groove and an S pole (e.g., positive or anode) is disposed in an upper portion thereof. The present inventive concept is not limited thereto, and the second magnet 364 may be installed such that the S pole is disposed in the lower portion of the second installation groove and the N pole is disposed in the upper portion thereof. In either case, the second magnet 364 may be provided such that the N pole and the S pole are positioned to be aligned with the longitudinal direction of the rotating shaft 342. For example, an anode and cathode of the second magnet 364 may be sequentially stacked in the longitudinal direction of the rotating shaft 342.

The second driving member 130 may be disposed above the second magnet 364. For example, in a case in which the second driving member 130 is made of an electromagnet, attractive force or repulsive force may be applied to the second driving member 130 and the second magnet 364, when a current is applied to the second driving member 130. Therefore, the second body 361 may be tilted by the second driving member 130 and the second magnet 364. In this case, since the second body 361 is connected to the installation member 342*a* by the second flexible member 362, the second body 361 may be easily tilted. Thereafter, when no current is applied to the second driving member 130, the second flexible member 362 may be restored and the second body 361 may be returned to its original shape.

As described above, a direction and magnitude of magnetic force may be controlled by adjusting a direction of the current applied to the second driving member 130 or by controlling a magnitude of the current.

In addition, the second driving member 130 may be provided with a second displacement sensor 132. The second displacement sensor 132 may sense a tilting angle of the second body 361. As an example, the second displacement sensor 132 may be connected to a controller (not illustrated), and may provide information to the controller about the sensed tilting angle of the second body 361. In this manner, the controller may precisely control a tilting angle of the second body 361 by sensing the tilting angle by the second displacement sensor 132.

Since the first rotating unit 150 and the second rotating unit 360 may be separately tilted as described above, the wafer W and the retainer ring R may be brought into close contact with the polishing pad 10 (see FIG. 1). Further, horizontal positions of the wafer W and the retainer ring R may be maintained separately.

A chemical mechanical polishing apparatus capable of independently maintaining the horizontal positions of the wafer and the retainer ring may be provided.

The various and advantageous advantages and effects of the present inventive concept are not limited to the above description, and can be more easily understood in the course of describing a specific embodiment of the present inventive concept.

While example embodiments have been illustrated and described above, it will be apparent to those skilled in the art that modifications and variations could be made without departing from the scope of the present inventive concept as defined by the appended claims.

What is claimed is:

1. A chemical mechanical polishing apparatus comprising:

a fixing portion; and a rotary body module including a rotating shaft rotatably provided on the fixing portion, a first rotating unit connected to the rotating shaft and on which a wafer is mounted, and a second rotating unit disposed around the first rotating unit and on which a retainer ring is mounted, wherein the fixing portion comprises a first driving member disposed above the first rotating unit and a second driving member disposed above the second rotating unit, wherein the first and second driving members are comprised of a magnet or an electromagnet, wherein a first magnet, disposed opposite to the first driving member, is provided in the first rotating unit, and a second magnet, disposed opposite to the second driving member, is provided in the second rotating unit, and wherein the first rotating unit and the second rotating unit are independently tilted.

2. The chemical mechanical polishing apparatus according to claim 1, wherein the fixing portion comprises a first displacement sensor provided in the first driving member, and a second displacement sensor provided in the second driving member.

3. The chemical mechanical polishing apparatus according to claim 1, wherein the second rotating unit is connected to the first rotating unit.

4. The chemical mechanical polishing apparatus according to claim 1, wherein the first and second magnets are arranged to sequentially stack an anode and a cathode in a longitudinal direction of the rotating shaft.

5. The chemical mechanical polishing apparatus according to claim 1, wherein the first rotating unit comprises:

a first body;

a first flexible member connecting the first body and the rotating shaft;

a first sealing member sealing a space formed by the first body and the rotating shaft; and a membrane provided on a lower end portion of the first body and including a lower surface on which the wafer is mounted.

6. The chemical mechanical polishing apparatus according to claim 5, wherein the second rotating unit comprises:

a second body including a lower surface on which the retainer ring is mounted;

a second flexible member connecting the first body and the second body; and a second sealing member sealing a space formed by the first body and the second body, together with the second flexible member.

7. The chemical mechanical polishing apparatus according to claim 6, wherein the first and second flexible members are comprised of any one of an engineering plastic material and a stainless steel (SUS) material.

8. The chemical mechanical polishing apparatus according to claim 6, wherein the first and second sealing members are comprised of an elastic material.

9. The chemical mechanical polishing apparatus according to claim 8, wherein the first and second sealing members are comprised of silicone or rubber.

10. The chemical mechanical polishing apparatus according to claim 1, wherein the first rotating unit and the second rotating unit are separately connected to the rotating shaft.

11. A rotary body module comprising:

a rotating shaft attached to a fixing portion;

a first rotating unit connected to the rotating shaft and on which a wafer is mounted;

a second rotating unit disposed around the first rotating unit and on which a retainer ring is mounted;

a first driving member disposed above the first rotating unit; and a second driving member disposed above the second rotating unit, wherein a first magnet, disposed opposite to the first driving member, is provided in the first rotating unit, and a second magnet, disposed opposite to the second driving member, is provided in the second rotating unit, and wherein the first rotating unit and the second rotating unit are configured to be independently tilted.

12. The rotary body module according to claim 11, wherein the first driving member disposed above the first rotating unit and the second driving member are provided on the fixing portion.

13. The rotary body module according to claim 12, wherein the first and second driving members are comprised of a magnet or an electromagnet.

14. The rotary body module according to claim 11, wherein the first rotating unit comprises:

a first body;

a first flexible member connecting the first body and the rotating shaft;

a first sealing member sealing a space formed by the first body and the rotating shaft; and a membrane provided on a lower surface of the first body and on which the wafer is mounted.

15. The rotary body module according to claim 14, wherein the second rotating unit comprises:

a second body including a lower surface on which the retainer ring is mounted;

a second flexible member connecting the first body and the second body; and a second sealing member sealing a space formed by the first body and the second body, together with the second flexible member.

* * * * *